US005118958A

United States Patent [19]

Noshi et al.

[11] Patent Number: 5,118,958

[45] Date of Patent: Jun. 2, 1992

[54] APPARATUS FOR DETECTING RESIDUAL YARN

[75] Inventors: Shinji Noshi; Norio Kubota, both of Kyoto; Hiroshi Uchida, Oumihachiman; Yasunobu Tanigawa, Joyo, all of Japan

[73] Assignee: Murata Kikai Kabushiki Kaisha, Kyoto, Japan

[21] Appl. No.: 493,960

[22] Filed: Mar. 15, 1990

[30] Foreign Application Priority Data

Mar. 18, 1989 [JP] Japan ..... 1-31211[U]
Jul. 7, 1989 [JP] Japan ..... 1-79586[U]

[51] Int. Cl.[5] ..... G01N 21/86; D03D 47/36

[52] U.S. Cl. ..... 250/571; 250/234; 250/561; 139/452; 356/429

[58] Field of Search ..... 356/429-431, 356/238; 250/571, 561, 234-235, 222.1; 139/452

[56] References Cited

U.S. PATENT DOCUMENTS

| | | | |
|---|---|---|---|
| 3,777,168 | 12/1973 | Sansone | 356/238 |
| 3,971,522 | 7/1976 | Pfarrwaller | 139/452 |
| 4,276,910 | 7/1981 | Eichenberger | 250/571 |
| 4,865,085 | 9/1989 | Ghiardo | 356/429 |
| 4,936,356 | 6/1990 | Ghiardo | 139/452 |

*Primary Examiner*—David C. Nelms
*Assistant Examiner*—Michael Messinger
*Attorney, Agent, or Firm*—Spensley Horn Jubas & Lubitz

[57] ABSTRACT

A bobbin discharge apparatus having a device for detecting a remaining yarn of a bobbin. A non-contact type sensor such as a photo sensor for detecting the presence or absence of the remaining yarn on a bobbin is arranged on a carrier passage of bobbins, and the bobbin and the sensor are provided relatively movably.

13 Claims, 4 Drawing Sheets

APPARATUS FOR DETECTING RESIDUAL YARN

FIELD OF THE INVENTION

The present invention relates to a bobbin discharge apparatus, and particularly to a bobbin discharge apparatus having a device for detecting the remaining yarn of a bobbin delivered from a fiber machine such as a winder.

RELATED ART STATEMENT

As a system for carrying spinning bobbins from a spinning frame to a winder where a rewinding process takes place, there is a system in which spinning bobbins are inserted into a tray and individually independently supplied to the winder.

On the other hand, discharged from the winder are empty bobbins from which yarns have been already supplied, bobbins with remaining yarns, half-bobbins having a large amount of yarns capable of being again supplied to the winder, and the like. Among them, the empty bobbins are separated from the tray and again carried to the spinning frame.

Accordingly, the empty bobbins discharged from the winder and the bobbins with remaining yarns are discriminated. For example, "Bobbin Removing Apparatus" is disclosed in Japanese Patent Application Laid-Open No. 188373/1986.

This apparatus is designed so that an upright carrier passage is connected to a discharge passage for bobbins discharged from the winder, and the empty bobbins removed from the tray and the bobbins with remaining yarns are supplied in a mixed manner to the carrier passage. It is also designed so that the bobbins with remaining yarns are discriminated in the carrier passage, and the thus discriminated bobbins with remaining yarns are discharged outside the carrier passage system.

A brush type sensor for discharging bobbins with remaining yarns outside the carrier passage is mounted on the aforementioned apparatus. When the bobbin moves upward, the remaining yarn engages the brush whereby a feeler rotates to actuate a proximity switch. However, the end of the brush is altered in a short period (2 to 3 months) so as not to engage remaining yarns, or waste is adhered to the brush so that the remaining yarn is sometimes erronously detected.

OBJECT AND SUMMARY OF THE INVENTION

An object of the present invention is to solve the above-described problems and is to propose a detecting device for remaining yarns including a non-contact type sensor. In the present invention, a non-contact type sensor such as a photo-sensor for detecting the presence or absence of the remaining yarn on a bobbin is arranged on a carrier passage of bobbins, and the bobbin and the sensor are provided relatively movably.

The present invention may provide an apparatus for detecting yarns in an extremely small amount remaining on a bobbin delivered from a winder, the apparatus comprising a photosensor for projecting light on the bobbin to detect a reflecting light reflected from the remaining yarn, and a sensor elevating means for elevating the sensor along the bobbin, whereby the presence or absence of the remaining yarn is detected without contact over the full length of the bobbin by means of the photosensor.

DETAILED DESCRIPTION OF PREFERRED EMBODIMENTS

Figure 1:
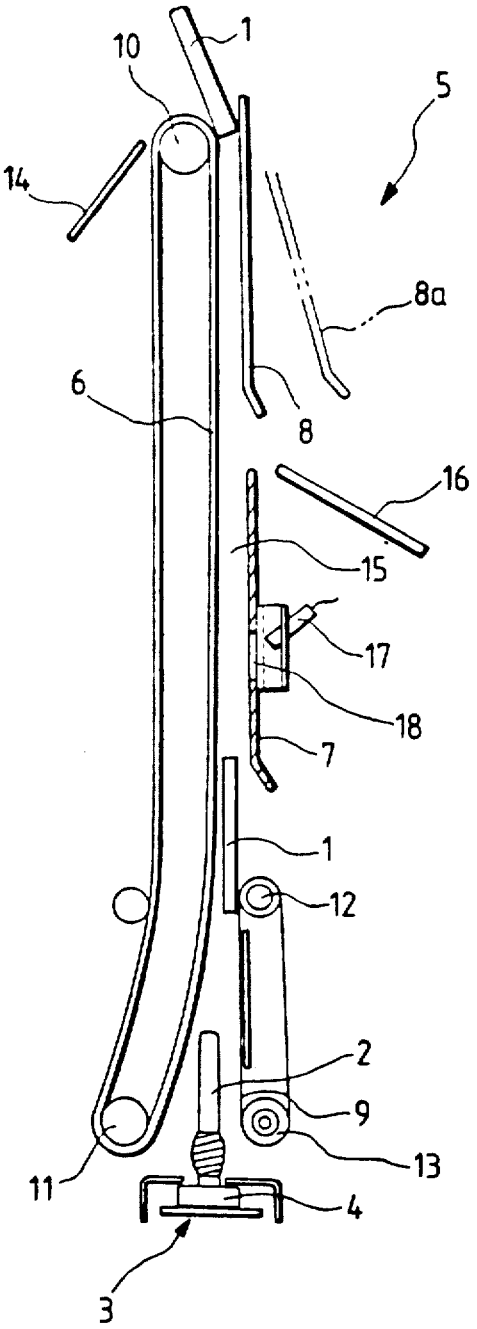
FIG. 1 is a schematic structural front view showing an embodiment of the apparatus according to the present invention.

An embodiment of the present invention will be described with reference to the drawings. In FIG. 1, a carrier passage 3 for discharging an empty bobbin 1 and a bobbin with remaining yarn 2 from the winder is provided in the form of a conveyor. An empty bobbin or the bobbin with remaining yarn 2 stood upright on a tray are carried in a mixed manner through the carrier passage 3. Midway along the carrier passage is provided a removing device 5 for removing the empty bobbin 1 and the bobbin with remaining yarn 2 from the tray 4. The removing device 5 is composed of a belt 6 which travels axially of the bobbin, bobbin guides 7 and 8 are opposingly arranged with the belt 6 and a bobbin press-belt 9.

More specifically, a flat belt 6 is extended over pulleys 10 and 11 vertically spaced apart to form a belt conveyor. Bobbin guide plates 7 and 8 are opposed to each other parallel to the belt. A lower flat belt 9 which forms a bobbin receiving passage of the carrier passage is further provided below the guide plate 7, the lower flat belt 9 being extended over pulleys 12 and 13. The pulleys 11 and 13 are supported so that they may be swung in a direction toward and away from each other.

Above the belt 6, an empty bobbin chute 14 for transporting the empty bobbin 1 to the other carrier system is provided to be downwardly inclined. A chute for discharging a bobbin with remaining yarn for discharging the bobbin with remaining yarn outside a carrier passage 15 is branched in the midst of the carrier passage 15. The guide plates 7 and 8 are parallelly moved in a direction toward and away from the belt carrier surface by means of a link mechanism not shown, and are urged toward the belt carrier surface by the force of a spring when the bobbin does not pass. Accordingly, only when the bobbin passes, the guide plates parallelly move according to the diameter of the bobbin to transport the bobbin in a state where the latter is held under pressure between the belt 6 and the guide plates 7 and 8. The upper guide plate 8 can be turned to a position 8*a* indicated by two-dot contour lines by a drive source such as a rotary solenoid. That is, when the bobbin with remaining yarn is detected by a sensor which will be described later, the guide plate 8 turns to the position indicated by two-dot contour lines to discharge the removed bobbin with remaining yarn onto the chute 16.

Particularly in the present invention, a non-contact type sensor 17 for detecting a remaining yarn is mounted at a predetermined position of the guide plate 7. The sensor 17 preferably comprises a limited distance reflective type photoelectric switch. The sensor 17 is secured to the guide plate 7, and the guide plate 7 is formed with a light transmissive window 18.

Figure 2:
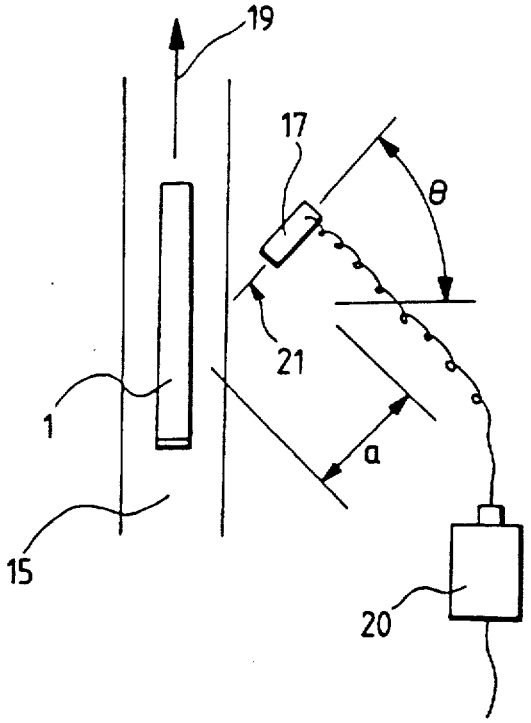
FIG. 2 is a front view of essential parts.

The sensor is mounted as shown in FIG. 2 so that light may be irradiated and reflected at an angle of $\theta$ with respect to the carrying direction 19 of the bobbin, and the distance a to the bobbin surface is also adjustably set by sensitivity of the sensor. If the distance a is once set, the distance to the bobbin surface is always constance since the sensor also moves together with the guide plate 7 even if the diameter of the bobbin is different. For example, the aforesaid angle $\theta$ is preferably 45 to 60 degrees, and the distance a is desirably amout 10 mm.

Reference numeral 20 designates an amplifier which sets sensitivity of the sensor and actuates the rotary solenoid for driving the guide 8.

Next, the operation will be described.

As shown in FIG. 1, the tray 4 transported in the carrier passage 3 stops at the removing device, and the empty bobbin 1 or the bobbin 2 with remaining yarn 2 is removed by the action of the belt 6 and the belt 9. In a case where the removed bobbin is the empty bobbin 1 without any yarn, the sensor 17 does not sense it, and therefore, the empty bobbin is carried to the upper end of the belt 6 and drops on the chute 14 and is then discharged to another carrier system.

On the other hand, in a case where the removed bobbin is the bobbin with remaining yarn 2, the remaining yarn is detected by the sensor 17 halfway of upward movement, and the solenoid for driving the guide plate 8 is turned on by a signal for detecting the remaining yarn. The guide plate 8 moves to the position indicated by two-dot contour lines 8*a*, and the bobbin with remaining yarn 2 is dropped on the other chute 16 separately from the chute for empty bobbin.

The angle of light 21 by the sensor 17 is set so that the light may be incident from an oblique angle with respect to the carrying direction of the bobbin whereby better accuracy of detection may be obtained than the case where the light is incident at right angles to the carrying direction. Even a remaining yarn merely wound about the bobbin a few times can be detected.

Figure 3:
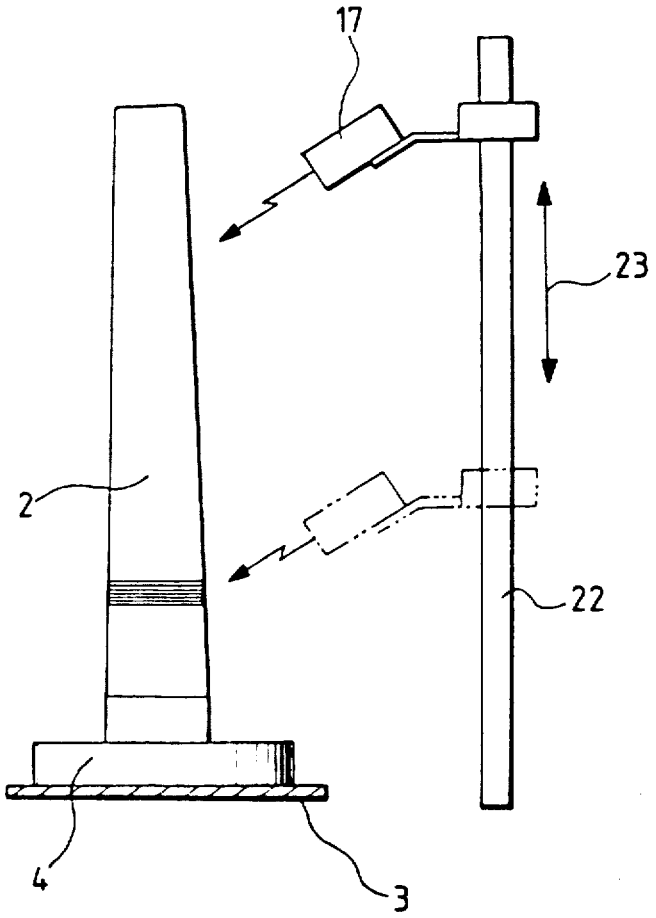
FIG. 3 is a front view showing another embodiment.

FIG. 3 shows the other embodiment, which shows the case where the empty bobbin and the bobbin with remaining yarn are discriminated without removing the bobbin 2 from the tray 4, and the sensor 17 is moved in an axial direction of the bobbin for detection. The irradiation angle of light is similar to the previous embodiment. The sensor 17 is movable in a direction of arrow 23 along the guide rod 22. As moving means, well-known drive means such as the ball threads, fluid cylinders, and the motor and belt can be applied.

As described above, according to the present invention, the detection of the remaining yarn on the bobbin can be done, and therefore, the present apparatus can withstand use for a long period of time, as compared with the case where the yarn is directly detected as in the brush, and even a small amount of yarn can be detected.

Next, another embodiments in which a sensor elevating means for elevating a sensor along a bobbin is included will be described with reference to the drawings.

Figure 4:
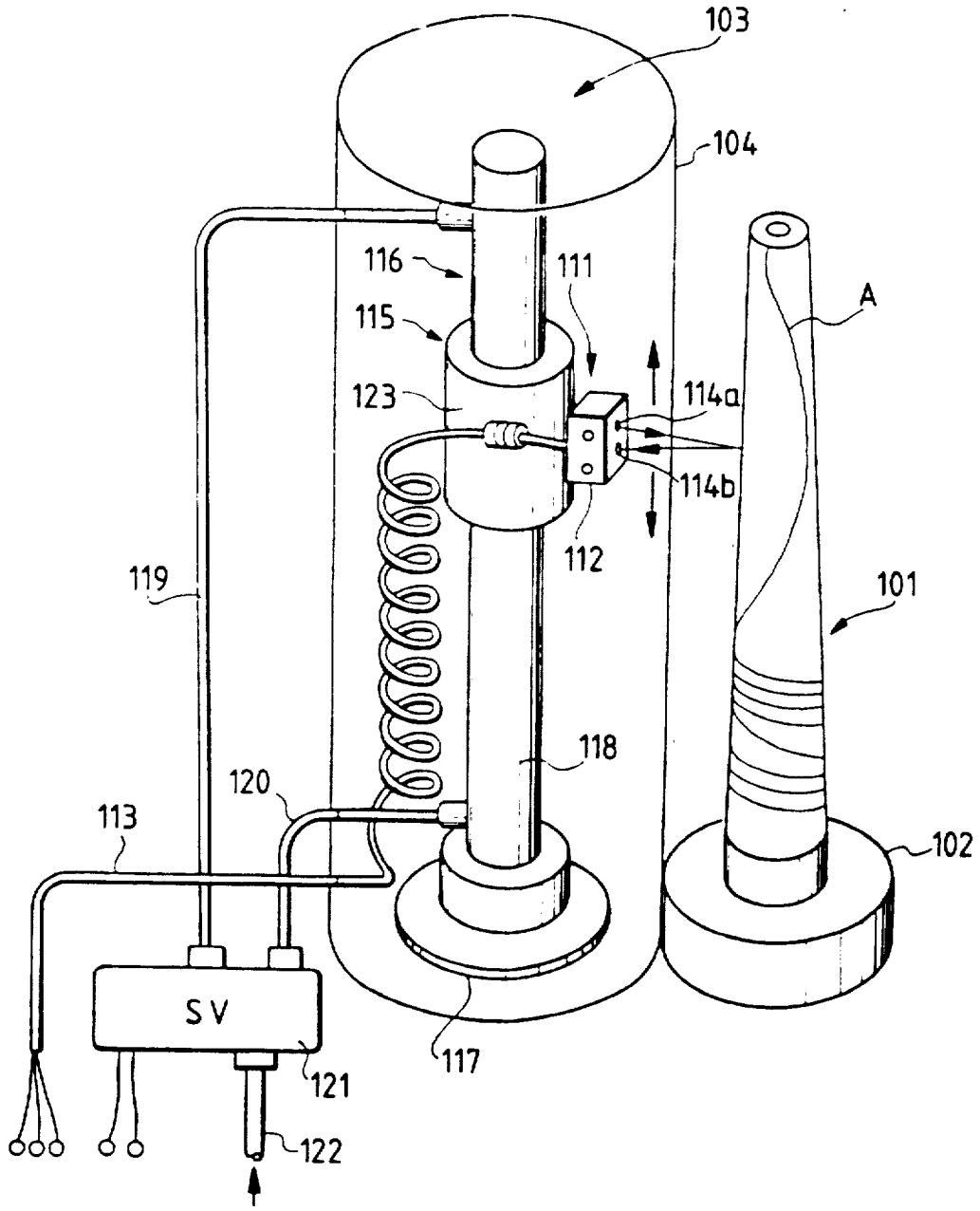
FIG. 4 is a perspective view showing another embodiment of the present invention.

FIG. 4 shows a third embodiment. As shown, a bobbin 101 having an extremely small amount of remaining yarn A is mounted on a tray 102 and delivered from a winder. In the illustration, a bobbin 101 of a straight taper type is shown. When the bobbin 101 is carried to a predetermined position, the presence or absence of the remaining yarn A of the bobbin 101 is detected by a remaining yarn detection device 103, which is housed in a tubular transparent cover member 104 made of acrylic material in order to prevent an entry of waste.

The detector 103 has a photo sensor (a photoelectric feeler) 111 for detecting the presence or absence of the remaining yarn A. A wire 113 is connected to the body 112 of the photosensor 111, and a projecting portion 114*a* for emitting light toward the bobbin 101 and a light receiving portion 114*b* for detecting a reflecting light reflected from the remaining yarn A are provided up and down.

The photo sensor 111 is moved up and down substantially parallel to the bobbin 101 by means of a sensor elevating means 115.

The sensor elevating means 115 comprises a rodless type air cylinder 116. The air cylinder 116 has a cylinder portion 118 which is held on a support bed 117 and stood upright parallel to a tapered portion of the bobbin 101. Connection pipes 119 and 120 are connected to upper and lower ends, respectively, of the cylinder portion 118, and a solenoid valve 121 is connected to these air pipes 119 and 120. An air pipe 122 for supplying pressure air is connected to the solenoid valve 121. A piston portion 123 for holding a sensor body 112 is provided on the cylinder portion 118, the piston portion 123 being elevated along the cylinder portion 118 by air supposed to the upper and lower ends of the cylinder portion 118.

With the structure as described above, when the bobbin 101 is carried to the remaining yarn detector, the solenoid valve 121 is opened to supply working air to the cylinder portion 118. Thereby, the piston portion 123 is elevated, and the photo sensor 111 is moved over the whole height area of the bobbin 101. In the upward and downward movement of the photo sensor 111, a substantially given angle substantially equal in distance from the bobbin surface is maintained, and light is projected against the bobbin 101 from the projecting portion 114*a* of the photo sensor 111 to detect the presence and absence of the remaining yarn A.

The light from the projecting portion 114*a* is reflected from the bobbin surface, which reflected light is detected by the light receiving portion 114*b*. A difference in the amount of light detected by the light receiving portion 114*b* occurs between the case where the remaining yarn A is present and the case where the remaining yarn A is absent, and the presence or absence of the remaining yarn A is judged on the basis of the quantities of light.

Figure 5:
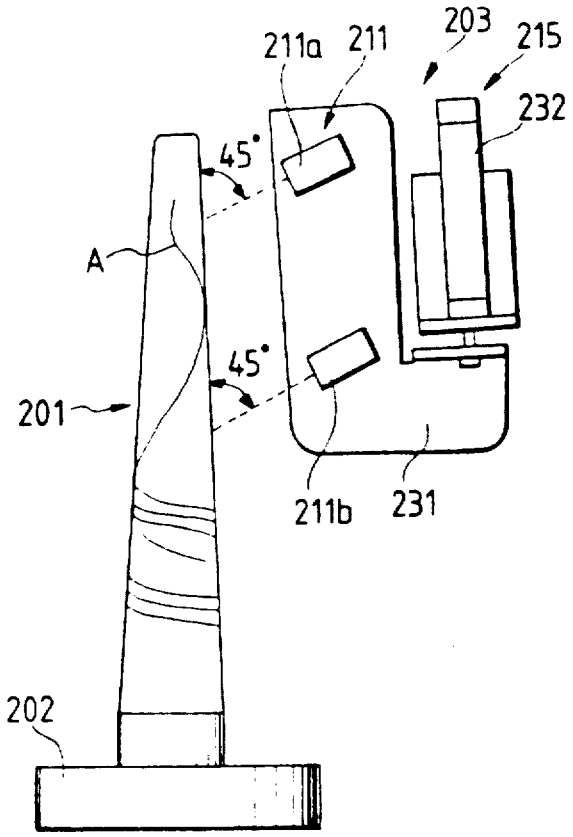
FIGS. 5 and 6 are respectively front views showing still another embodiments.

FIG. 5 shows a fourth embodiment. Similarly to the previous embodiment, the bobbin 201 of the straight tapered type is delivered from the winder, and the presence or absence of the remaining yarn A of the bobbin 201 is detected by the photo sensor (beam sensor) 211.

The photo sensor 211 is composed of an upper sensor 211*a* and a lower sensor 211*b* which are mounted up and down on an L-shaped base plate 231. These sensors 211*a* and 211*b* are directed downwardly by 45° with respect to the axis of the bobbin 201 to project the light on the remaining yarn A whereby the reflecting light reflected is detected. That is, the upper sensor 211*a* detects the presence or absence of the remaining yarn A above the central portion of the bobbin 201, whereas the lower sensor 211*b* detects the presence or absence of the remaining yarn A below the central portion of the bobbin 201.

An air cylinder 232 as a sensor elevating means 215 is connected to a base plate 231 to hold it. The air cylinder 232 causes the sensor 211 to elevate in equally spaced relation from the bobbin surface along the tapered portion of the bobbin 1 through the base plate 231.

Accordingly, the light is projected against the bobbin 201 from the sensors 211*a* and 211*b* which are elevated by the air cylinder 232, and the presence or absence of the remaining yarn A is to be detected every sensors 211*a* and 211*b*.

The air cylinder 232 is expanded and contracted in the range of detection of the sensors 211*a* and 211*b*, and the amount of stroke half of the full length of the bobbin will suffice. Accordingly, the detector becomes compact, and since the amount of movement thereof is small, the presence or absence of the remaining yarn can be detected early.

Figure 6:
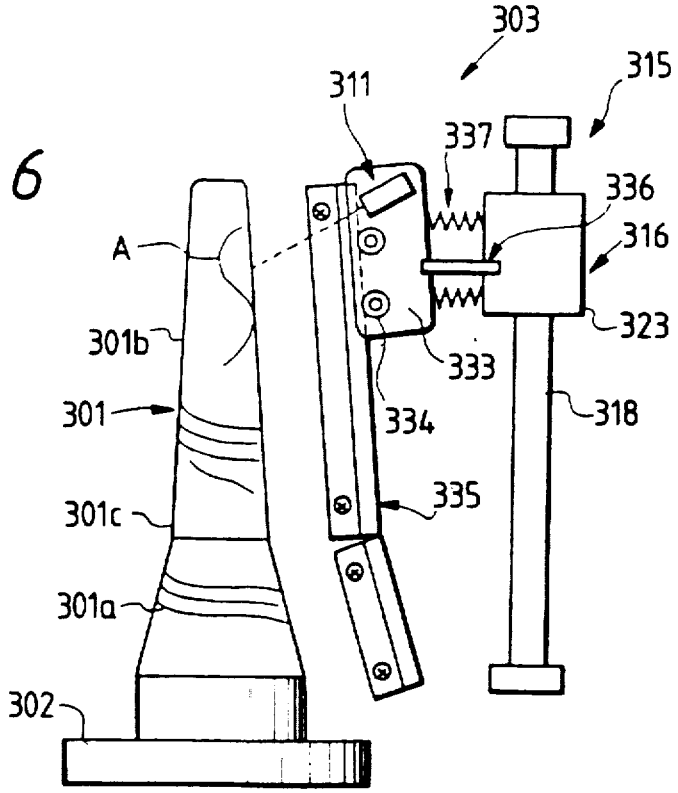

FIG. 6 shows a fifth embodiment, which is particularly designed to detect the remaining yarn A of the bobbin 301 of a 2-stage tapered type.

The bobbin 301 is formed with a lower tapered portion 301*a* having a large taper diameter and an upper tapered portion 301*b* having a small taper diameter extended upwardly thereof, these tapered portions 301*a* and 301*b* being formed with an off-set portion 301*c*.

In the remaining yarn detector 303, a single photo sensor 311 directed downwardly by a predetermined angle toward the bobbin 301 is secured to the side of a base plate 333 in order to detect the remaining yarn A of the bobbin 301, and a pair of cam rollers 334 are supported rotatably up and down on the base plate 333. These rollers 334 roll on a guide rail 335 supported upright over the full length of the bobbin parallel to and equally distanced from the bobbin 301. The guide rail 335 is turned back from the offset portion along each of the tapered portions of the bobbin and inclined.

The sensor 311 is elevated axially of the bobbin 301 by means of a rodless air cylinder 316 which constitutes an elevating means 315. The air cylinder 316 has a cylinder portion 318, and an arm 336 for horizontally swingably holding a base plate 333 is extended from a piston portion 323 for elevating the cylinder portion 318, and a pair of springs 337 for urging the base plate 333 against the guide surface of a guide rail 335 are connected thereto.

Accordingly, the base plate 333 is elevated algont the guide rail 335 by the operation of the air cylinder 316. The photo sensor 311 projects the light over the full length of the bobbin always maintaining a substantially given distance from the bobbin surface while maintaining the detection angle at substantially constant. When the remaining yarn A is present, the remaining yarn A is to be detected by the reflecting light reflected from the remaining yarn A.

As described above, according to the present invention, the presence or absence of the remaining yarn A is detected without contact by the photo sensor 311, and therefore, even a small amount of yarn can be positively detected. In addition, erroneous detection can be minimized even for a long period of time, thus providing high reliability.

In sum, according to the present invention, since the presence or absence of the remaining yarn is detected by the photo sensor, even a slight amount of yarn can be positively detected, and in addition, erronous detection can be minimized even for a long period of time.

What is claimed is:

1. An apparatus for detecting residual yarn on a bobbin delivered from a winder, comprising sensor means for sensing the residual yarn on the bobbin;

moving means for moving the sensor means relative to a predetermined portion of the bobbin during a sensing operation to sense residual yarn along the predetermined portion of the bobbin.

2. An apparatus according to claim 1, wherein the moving means moves the sensor means in a direction substantially parallel to the bobbin.

3. An apparatus according to claim 1, wherein the sensor means comprises a non-contact type sensor.

4. An apparatus according to claim 3, wherein the non-contact type sensor comprises a photo sensor.

5. An apparatus according to claim 4, wherein the photo sensor is housed in a transparent casing.

6. An apparatus according to claim 5, wherein the photo sensor and the moving means are housed in the transparent casing.

7. An apparatus according to claim 1, wherein the moving means comprises a rodless type air cylinder.

8. An apparatus according to claim 1, wherein the sensor means comprises first and second non-contact type sensors mounted at first and second respective positions on a supporting member, the supporting member being movable by the moving means so as to move the first and second sensors in a predetermined spaced relationship relative to the bobbin.

9. An apparatus according to claim 8, wherein the first and second non-contact type sensors comprise first and second photo sensors.

10. An apparatus according to claim 9, wherein the moving means comprises a rodless type air cylinder.

11. An apparatus according to claim 9, wherein the moving means comprises an air cylinder having a rod movably projecting therefrom, the rod being connected to the supporting member such that movement of the rod causes relative movement of the supporting member.

12. An apparatus according to claim 1, wherein the sensor means comprises a photo sensor directed toward the bobbin at a predetermined angle, a base plate for supporting the photo sensor, a pair of cam rollers rotatably supported by the base plate, and a guide rail arranged parallel to and equidistant from the bobbin along a full length of the bobbin, wherein the pair of cam rollers rotatably contact the guide rail such that moving means moves the base plate along the guide rail, thereby enabling the photo sensor to sense for residual yarn along the full length of the bobbin.

13. An apparatus according to claim 12, wherein the guide rail includes an offset portion for accommodating a 2-stage tapered bobbin.

* * * * *